US012012684B2

(12) United States Patent
Yamanashi et al.

(10) Patent No.: US 12,012,684 B2
(45) Date of Patent: Jun. 18, 2024

(54) PROCESSING DATA GENERATION DEVICE, EMBROIDERY SEWING MACHINE, AND NON-TRANSITORY COMPUTER-READABLE STORAGE MEDIUM

(71) Applicant: BROTHER KOGYO KABUSHIKI KAISHA, Nagoya (JP)

(72) Inventors: Yoko Yamanashi, Konan (JP); Masashi Tokura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 65 days.

(21) Appl. No.: 17/878,462

(22) Filed: Aug. 1, 2022

(65) Prior Publication Data

US 2023/0029765 A1 Feb. 2, 2023

(30) Foreign Application Priority Data

Aug. 2, 2021 (JP) ..... 2021-126733

(51) Int. Cl.
*D05C 5/06* (2006.01)
*D05B 19/08* (2006.01)

(52) U.S. Cl.
CPC ..... *D05C 5/06* (2013.01); *D05B 19/08* (2013.01)

(58) Field of Classification Search
CPC ..... D05B 19/08; D05B 37/00; D05B 37/04; D05B 19/10; D05C 7/04; D05C 5/06
See application file for complete search history.

(56) References Cited

U.S. PATENT DOCUMENTS

| | | | | |
|---|---|---|---|---|
| 5,740,055 | A * | 4/1998 | Iwata | D05B 19/08 112/80.23 |
| 2011/0088606 | A1* | 4/2011 | Kawaguchi | D05B 19/04 112/470.04 |
| 2013/0116815 | A1* | 5/2013 | Muto | B26D 5/00 700/134 |
| 2014/0144359 | A1* | 5/2014 | Yamanashi | D05B 19/12 112/102.5 |
| 2015/0122165 | A1* | 5/2015 | Maki | D05B 81/00 700/134 |
| 2015/0240399 | A1* | 8/2015 | Ihira | D05C 7/00 112/102.5 |
| 2016/0031108 | A1* | 2/2016 | Bailie | B26D 5/005 700/134 |

FOREIGN PATENT DOCUMENTS

| | | |
|---|---|---|
| JP | H06-54970 A | 3/1994 |
| JP | H08-100363 A | 4/1996 |

* cited by examiner

*Primary Examiner* — Nathan E Durham
(74) *Attorney, Agent, or Firm* — Oliff PLC

(57) ABSTRACT

A processing data generation device includes an input portion, a processor, and a memory. The processor is configured to receive a detection signal of the input portion. The memory configured to store computer-readable instructions that, when executed by the processor, instruct the processor to perform processes. The processes include pattern identification processing of identifying a target pattern, region specification command acquisition processing of acquiring, via the input portion, a region specification command to select, as a cutting region, a first region surrounded by an outside of the target pattern and by the target pattern, and processing data generation processing of creating processing data for cutting out, from a workpiece to be cut, the cutting region specified by the region specification command, as an applique piece.

15 Claims, 8 Drawing Sheets

PROCESSING DATA GENERATION DEVICE, EMBROIDERY SEWING MACHINE, AND NON-TRANSITORY COMPUTER-READABLE STORAGE MEDIUM

CROSS REFERENCE TO RELATED APPLICATIONS

This application claims priority to Japanese Patent Application No. 2021-126733 filed Aug. 2, 2021, the content of which is hereby incorporated herein by reference in its entirety.

BACKGROUND

The present disclosure relates to a processing data generation device, an embroidery sewing machine, and a non-transitory computer-readable storage medium.

In a processing data generation device of known art, a contour of an existing character font is extracted, and, on the basis of the extracted contour, cutting data for cutting an applique piece using a cutting device, and sewing data for sewing the applique piece onto a sewing object are created.

SUMMARY

The known processing data generation device cannot generate, on the basis of the contour of the character font, the cutting data, and the sewing data for creating an applique pattern that differs from a shape of the character font.

Embodiments of the broad principles derived herein provide a processing data generation device, an embroidery sewing machine, and a non-transitory computer-readable storage medium that improve convenience for a user compared to known art, when creating an applique pattern that differs from a shape of a target pattern, on the basis of a contour of the target pattern.

Embodiments provide a processing data generation device that includes an input portion, a processor, and a memory. The processor is configured to receive a detection signal of the input portion. The memory configured to store computer-readable instructions that, when executed by the processor, instruct the processor to perform processes. The processes include pattern identification processing of identifying a target pattern, region specification command acquisition processing of acquiring, via the input portion, a region specification command to select, as a cutting region, a first region surrounded by an outside of the target pattern and by the target pattern, and processing data generation processing of creating processing data for cutting out, from a workpiece to be cut, the cutting region specified by the region specification command, as an applique piece. The processing data generation device contributes to generating the processing data for cutting out the first region from the workpiece to be cut. A user can acquire the applique piece that accords with the cutting region, by processing the workpiece based on the processing data. Compared to known art, the user can more easily obtain an applique pattern in which the applique piece that accords with the cutting region is combined with the target pattern. In other words, the processing data generation device contributes to improving convenience for the user, compared to the known art, when creating the applique pattern that differs from a shape of the target pattern, on the basis of a contour of the target pattern.

Embodiments also provide an embroidery sewing machine that includes an input portion, a sewing portion, a processor, a memory. The sewing portion has a needle bar.

The sewing portion is configured to drive the needle bar to reciprocate in an up-down direction to form stitches on a sewing object, in accordance with embroidery data. The processor is configured to receive a detection signal of the input portion, and to control the sewing portion. The memory is configured to store computer-readable instructions that, when executed by the processor, instruct the processor to perform processes. The processes include pattern identification processing of identifying a target pattern, region specification command acquisition processing of acquiring, via the input portion, a region specification command that selects, as a cutting region, a region surrounded by an outside of the target pattern and by the target pattern, and processing data generation processing of creating processing data for cutting out, from a workpiece to be cut, the cutting region specified by the region specification command, as an applique piece. The embroidery sewing machine contributes to generating the processing data for cutting out the first region from the workpiece to be cut. A user can acquire the applique piece that accords with the cutting region, by processing the workpiece based on the processing data. Compared to known art, the user can more easily obtain an applique pattern in which the applique piece that accords with the cutting region is combined with the target pattern. In other words, the embroidery sewing machine contributes to improving convenience for the user, compared to the known art, when creating the applique pattern that differs from a shape of the target pattern, on the basis of a contour of the target pattern.

Embodiments further provide a non-transitory computer-readable storage medium that stores computer-readable instructions that are executed by a processor of a processing data generation device, the computer-readable instructions performing processes. The processes include pattern identification processing of identifying a target pattern, region specification command acquisition processing of acquiring, via an input portion provided in the processing data generation device, a region specification command to select, as a cutting region, a first region surrounded by an outside of the target pattern and by the target pattern, and processing data generation processing of creating processing data for cutting out, from a workpiece to be cut, the cutting region specified by the region specification command, as an applique piece. When the processes stored in non-transitory computer-readable storage medium are executed, the processing data generation device contributes to generating the processing data for cutting out the first region from the workpiece to be cut. A user can acquire the applique piece that accords with the cutting region, by processing the workpiece based on the processing data. Compared to known art, the user can more easily obtain an applique pattern in which the applique piece that accords with the cutting region is combined with the target pattern. In other words, the processing data generation device contributes to improving convenience for the user, compared to the known art, when creating the applique pattern that differs from a shape of the target pattern, on the basis of a contour of the target pattern.

BRIEF DESCRIPTION OF THE DRAWINGS

Embodiments will be described below in detail with reference to the accompanying drawings in which.

DETAILED DESCRIPTION

Figure 1:
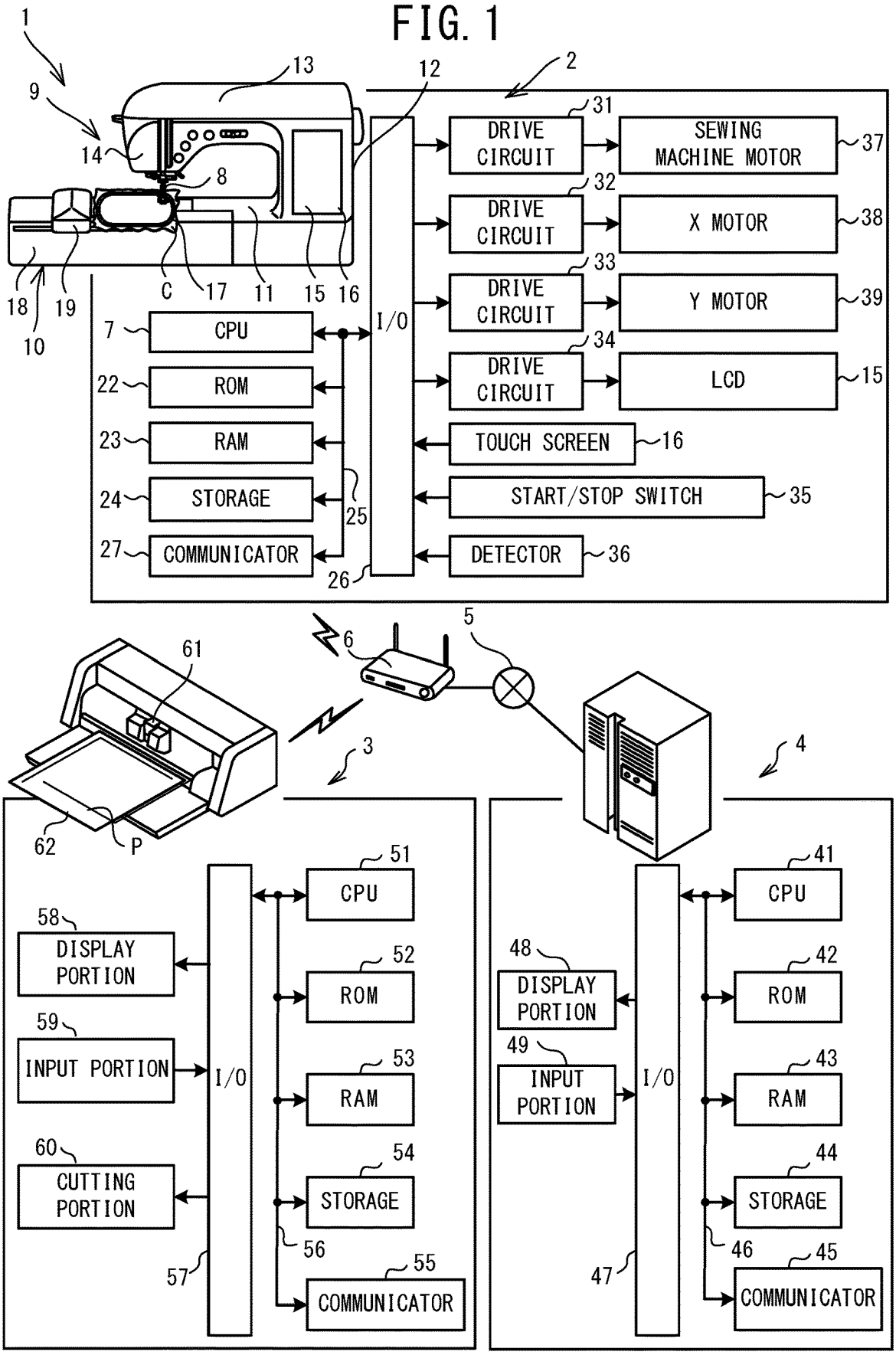
FIG. 1 is a block diagram showing an outline configuration of a system provided with an embroidery sewing machine, a cutting device, and a processing data generation device.

An embodiment of the present disclosure will be explained with reference to the drawings. As shown in FIG. 1, a system 1 is provided with an embroidery sewing machine 2 (hereinafter referred to as the "sewing machine 2"), a cutting device 3, and a processing data generation device 4 (hereinafter referred to as the "device 4"). The sewing machine 2 is configured to perform embroidery sewing. The cutting device 3 is configured to perform processing to cut a sheet-shaped workpiece P to be cut, in accordance with cutting data received via a network 5 and an access point 6. The workpiece P is a work cloth, for example. The device 4 is a personal computer (PC).

As shown in FIG. 1, the sewing machine 2 is provided with a bed portion 11, a pillar 12, an arm portion 13, a head portion 14, a sewing portion 9, and a movement mechanism 10. The bed portion 11 is a base of the sewing machine 2 and extends in the left-right direction. The pillar 12 is provided standing upward from the right end portion of the bed portion 11. An LCD 15 and a touch screen 16 are provided on the front surface of the pillar 12. The arm portion 13 extends to the left from the upper end of the pillar 12, so as to face the bed portion 11. The head portion 14 is a portion coupled to the left leading end portion of the arm portion 13. The sewing portion 9 is provided with a presser bar, a needle bar up-down drive mechanism, and the like, which are not shown in the drawings and are provided in the head portion 14. A sewing needle is detachably mounted at the lower end of a needle bar 8. The sewing portion 9 is provided with a shuttle mechanism that is not shown in the drawings and is provided in the bed portion 11. The sewing portion 9 is provided with the needle bar 8, and is configured to form stitches in a sewing object C, by driving the needle bar 8 up and down.

The movement mechanism 10 is configured to be able to move the sewing object C held by an embroidery frame 17 relative to the needle bar 8. The movement mechanism 10 is provided with a main body case 18 and a carriage 19. The main body case 18 houses an X-direction movement mechanism that is not shown in the drawings. The carriage 19 houses a Y-direction movement mechanism that is not shown in the drawings. At a time of embroidery sewing, a user mounts one of the embroidery frames 17, which is selected from among a plurality of the embroidery frames 17 having different sizes each other, to the carriage 19. The embroidery frame 17 is moved, by the Y-direction movement mechanism and the X-direction movement mechanism, to needle drop points indicated by an XY coordinate system (an embroidery coordinate system) unique to the sewing machine 2. The sewing machine 2 is configured to form an embroidery pattern on the sewing object C held by the embroidery frame 17, by driving the needle bar up-down drive mechanism and the shuttle mechanism of the sewing portion 9, in coordination with the movement of the embroidery frame 17.

The electrical configuration of the sewing machine 2 will be described. The sewing machine 2 is provided with a CPU 7, a ROM 22, a RAM 23, a storage 24, an input/output interface (I/O) 26, and a communicator 27. The CPU 7 is connected to the ROM 22, the RAM 23, the storage 24, the input/output I/O 26, and the communicator 27 via a bus 25. Drive circuits 31 to 34, the touch screen 16, a start/stop switch 35, and a detector 36 are connected to the input/output I/O 26. The detector 36 is configured to detect that the embroidery frame 17 has been mounted to the movement mechanism 10, and to output a detection result according to a type of the embroidery frame 17. The storage 24 stores various setting values. The storage 24 is configured to store embroidery data corresponding to each of a plurality of patterns that are candidates for a pattern to be sewn by the sewing machine 2.

A sewing machine motor 37 is connected to the drive circuit 31. The drive circuit 31 is configured to drive the sewing machine motor 37 in accordance with a control signal from the CPU 7. The needle bar up-down drive mechanism of the sewing portion 9 is driven in accordance with the driving of the sewing machine motor 37, and the needle bar 8 moves up and down. An X motor 38 is connected to the drive circuit 32. A Y motor 39 is connected to the drive circuit 33. The drive circuits 32 and 33 respectively are configured to drive the X motor 38 and the Y motor 39 in accordance with control signals from the CPU 7. The embroidery frame 17 mounted to the movement mechanism 10 is configured to move in the left-right direction (an X direction) and the front-rear direction (a Y direction) by movement amounts corresponding to the control signals, in accordance with the driving of the X motor 38 and the Y motor 39. The drive circuit 34 is configured to display an image on the LCD 15 in accordance with a control signal from the CPU 7. The communicator 27 is configured to connect the sewing machine 2 to the network 5 via the access point 6. The CPU 7 is configured to transmit and receive data with another device (the cutting device 3 and the device 4, for example) connected to the network 5, via the communicator 27.

The cutting device 3 is configured to cut the workpiece P using a cutting blade of a cartridge 61. The cutting device 3 is provided with a CPU 51, a ROM 52, a RAM 53, a storage 54, a communicator 55, an input/output interface (I/O) 57, a display portion 58, an input portion 59, and a cutting portion 60. The CPU 51 is connected to the ROM 52, the RAM 53, the storage 54, the input/output I/O 57, and the communicator 55 via a bus 56. The CPU 51 is configured to perform overall control of the cutting device 3. The storage 54 stores a cutting program to be executed by the CPU 51, the embroidery data, cutting data for cutting the workpiece P, and the like. The communicator 55 is an interface for connecting the cutting device 3 to the network 5 via the access point 6. The CPU 51 is configured to transmit and receive data with another device (the sewing machine 2 and the device 4, for example) connected to the network 5, via the communicator 55. The display portion 58, the input portion 59, and the cutting portion 60 are connected to the input/output I/O 57. The display portion 58 is configured to display an image, and is a liquid crystal display, for example. The input portion 59 is a touch screen provided on the surface of the display portion 58. The cutting portion 60 includes a conveyance mechanism, a first movement mechanism, and a second movement mechanism. The conveyance mechanism is configured to convey a holding plate 62, which is configured to hold the workpiece P on an upper surface thereof, in a sub-scanning direction. The first movement mechanism is configured to move the cartridge 61 in a main scanning direction. The second movement mechanism is configured to move the cartridge 61 in the up-down direction that is orthogonal to the main scanning direction and the sub-scanning direction. The CPU 51 is configured to control the cutting portion 60 as described below, on the basis of the embroidery data and the cutting data stored in the storage 54. The CPU 51 is configured to control the second movement mechanism and to move the cartridge 61 downward to cause the cutting blade to come into contact with the workpiece P. In this state, the CPU 51 is configured to control the conveyance mechanism and the first movement mechanism and to move the holding plate 62 and the cartridge 61. In this way, the cutting blade is configured to move relative to the workpiece P in the main scanning direction and the sub-scanning direction to cut the workpiece P.

The device 4 is provided with a CPU 41, a ROM 42, a RAM 43, a storage 44, a communicator 45, an input/output interface (I/O) 47, a display portion 48, and an input portion 49. The CPU 41 is electrically connected to the ROM 42, the RAM 43, the storage 44, the communicator 45, and the input/output I/O 47 via a bus 46. The CPU 41 is configured to control the device 4. A boot program, a BIOS, and the like are stored in the ROM 42. Temporary data may be stored in the RAM 43. Various setting values are stored in the storage 44. In a similar manner to the storage 24, the storage 44 may store the embroidery data. The communicator 45 is an interface for connecting the device 4 to the network 5. The CPU 41 is configured to transmit and to receive data with another device (the sewing machine 2 and the cutting device 3, for example) connected to the network 5, via the communicator 45. The display portion 48, and the input portion 49 are connected to the input/output I/O 47. The display portion 48 is configured to display an image, and is a liquid crystal display, for example. The input portion 49 includes a keyboard and a mouse.

Main processing of the sewing machine 2 will be described with reference to FIG. 2 to FIG. 7. It is assumed that a case in which an applique pattern E1 is created on the basis of embroidery data D for sewing an embroidery pattern E shown in FIG. 3 is a first specific example, a case in which an applique pattern E2 is created on the basis of the embroidery data D is a second specific example, and a case in which an applique pattern E3 is created on the basis of the embroidery data D is a third specific example. The main processing is performed when a user inputs a start command to activate the main processing by operating the sewing machine 2 after inputting a command specifying the type of the embroidery frame 17 to be used, and specifying the embroidery pattern. The type of the embroidery frame 17 is selected from among the plurality of embroidery frames 17 stored in the storage 24, for example. When the CPU 7 of the sewing machine 2 detects the start command, the CPU 7 reads out, to the RAM 23, a processing data generation program for performing the main processing stored in a program storage area of the ROM 22. The CPU 7 performs the following steps in accordance with commands included in the processing data generation program read out to the RAM 23. Various parameters necessary for performing the main processing are stored in the storage 24. Various data obtained in the course of the main processing will be stored as necessary in the RAM 23. In the main processing described below, the processing other than sewing processing at step S33 and step S34 is performed by the device 4, and it is sufficient that the sewing processing be performed by the sewing machine 2 on the basis of applique pattern data generated by the device 4.

As shown in FIG. 3, the embroidery pattern E, common to the first to third specific examples, is sewn using threads of seven colors, and is a pattern in which the alphabetic character A, and plant motifs decorating the alphabetic character A are combined. The embroidery pattern E according to the specific examples include seven partial patterns divided by each of the thread colors. The embroidery data D includes partial pattern data, in a sewing order, for sewing the partial patterns divided by each of the thread colors. Each of the partial pattern data includes coordinate data and thread color data. The coordinate data is data indicating formation positions of stitches included in the embroidery pattern E, that is, indicating coordinates, in the embroidery coordinate system, of the positions of the needle drop points. Specifically, the coordinate data includes data groups representing a plurality of coordinates for each of the needle drop points. The thread color data indicates the colors of the threads for sewing the embroidery pattern E. Each of the applique patterns E1 to E3 is a pattern in which an applique piece and a target pattern T are combined. A shape of a cutting region M for cutting out the applique piece from the workpiece P to be cut is set on the basis of a contour of the target pattern T, of the embroidery pattern E. The target pattern T includes one or more of the partial patterns, of the plurality of partial patterns configuring the embroidery pattern E. The target pattern T of each of the first to third specific examples is the partial pattern of the alphabetic character A. The target pattern T is a pattern having a portion surrounding a periphery of a first region M3 in which stitches are not formed, that is, a pattern including an annular portion. In the description below, of contours C1 and C2 of the target pattern T, the contour C1 that encompasses the other contour C2 will also be referred to as an outer contour, and the contour C2 encompassed by the contour C1 will also be referred to as an inner contour. The inner contour C2 is in contact with the first region M3, and defines a contour of the first region M3. The outer contour C1 is separated from the first region M3.

The sewing machine 2 of the present embodiment can select one type of command, from three types of command that are a first command, a second command, and a third command, as a region specification command specifying a setting method of the cutting region M on the basis of the target pattern T, when it is a pattern that can be defined by the outer contour C1 and the inner contour C2, as in the case of the target pattern T. The first command is a command in which the first region M3 outside the target pattern T and surrounded by the target pattern T is set as the cutting region M. A region outside of the target pattern T is a region in which stitches are not formed, from among regions delineated by the contours C1 and C2. The first region M3 is the region surrounded by the inner contour C2 of the target pattern T, in which the stitches of the target pattern T are not formed. The inner contour C2 is the annular contour surrounded by the outer contour C1. The applique pattern E3 according to the third specific example is the applique pattern created when the first command is selected as the region specification command. The applique pattern E3 is a pattern in which an applique piece Q3, obtained by cutting out the first region M3 as the cutting region M, is combined with the embroidery pattern E. The second command is a command in which a second region M1, which is surrounded by the outer contour C1 that is the contour of the target pattern T separated from the first region M3, and which includes the first region M3, is set as the cutting region M. The second region M1 is a region surrounded by the outer contour C1 of the target pattern T and including a region in which the stitches of the target pattern T are formed and a region in which the stitches of the target pattern T are not formed. The applique pattern E1 according to the first specific example is the applique pattern created when the second command is selected as the region specification command. The applique pattern E1 is a pattern in which an applique piece Q1, obtained by cutting out the second region M1 as the cutting region M, is combined with the embroidery pattern E excluding the target pattern T. The third command is a command in which a third region M2 excluding the first region M3 from the second region M1 is set as the cutting region M. The third region M2 is a region, between the inner contour C2 and the outer contour C1 of the target pattern T, in which the stitches of the target pattern T are formed. The applique pattern E2 of the second specific example is the applique pattern created when the third command is selected as the region specification command. The applique pattern E2 is a pattern in which an applique piece Q2, obtained by cutting out the third region M2 as the cutting region M, is combined with the embroidery pattern E excluding the target pattern T. In the following description, when no distinction is made between the applique pieces Q1 to Q3, they will also be referred to as the applique piece Q or the applique pieces Q.

Figure 2:
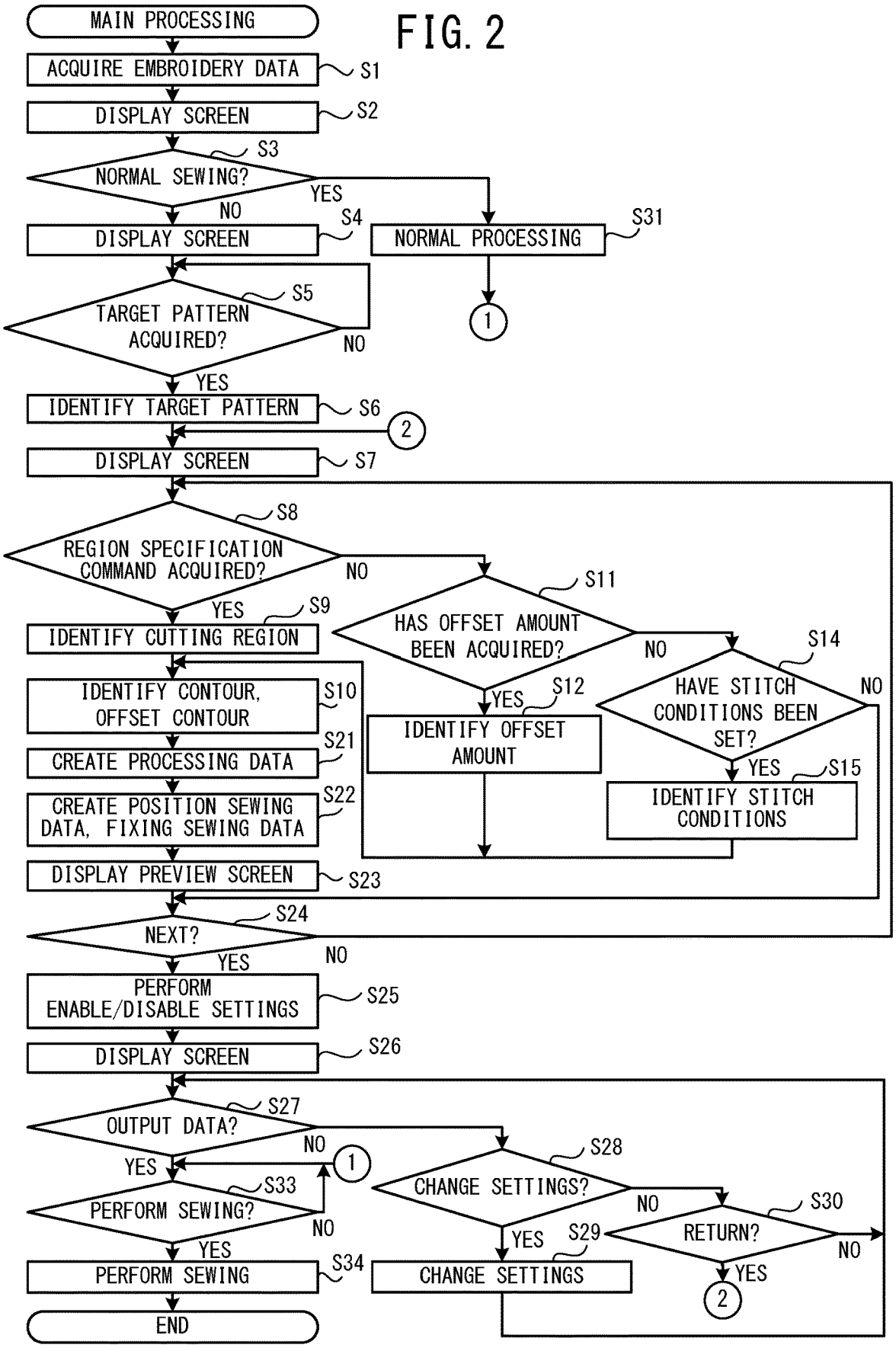
FIG. 2 is a flowchart of main processing performed by the embroidery sewing machine.
Figure 3:
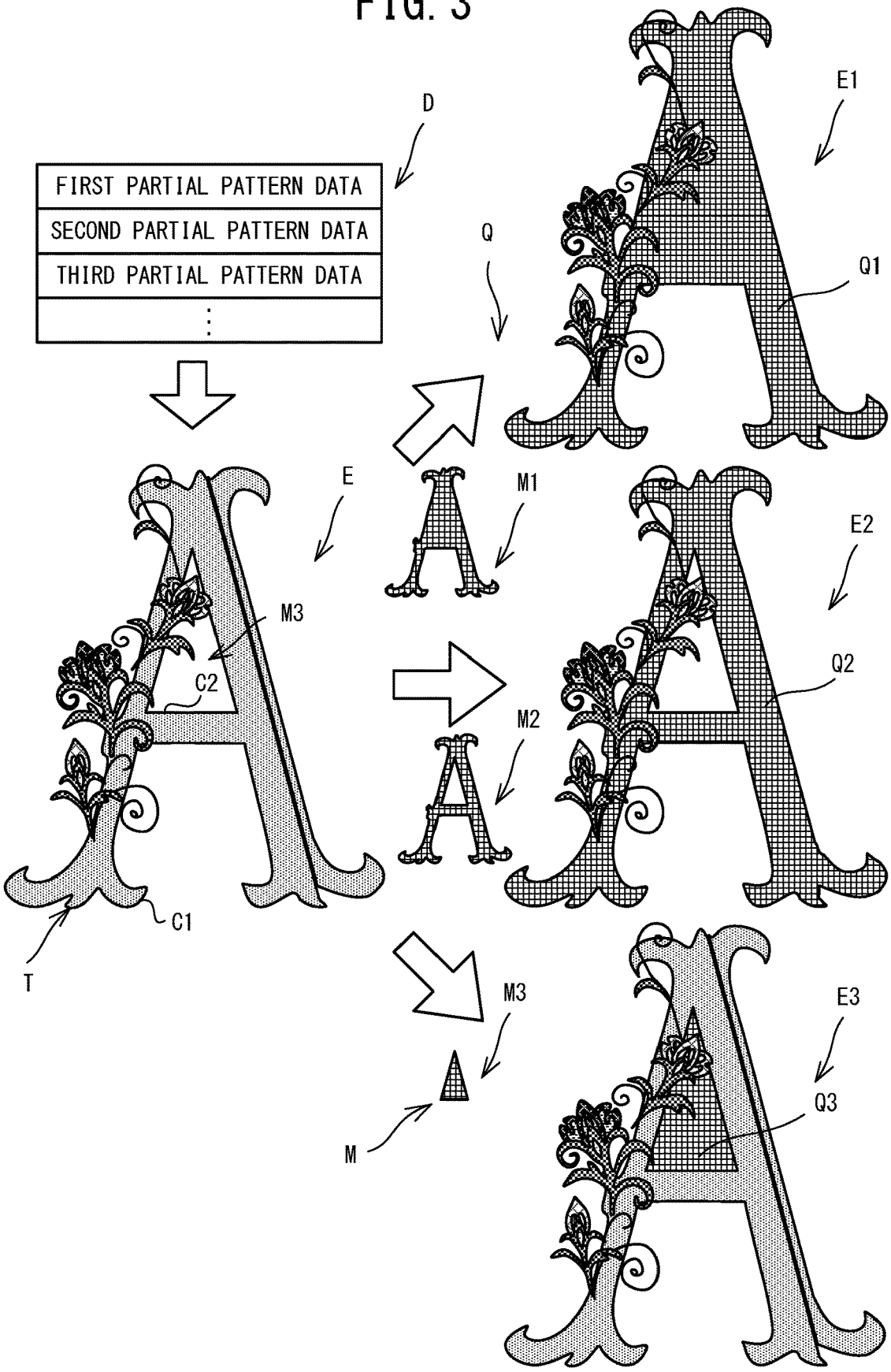
FIG. 3 is an explanatory diagram of embroidery patterns sewn on the basis of embroidery data and applique patterns edited on the basis of the embroidery data.
Figure 4:
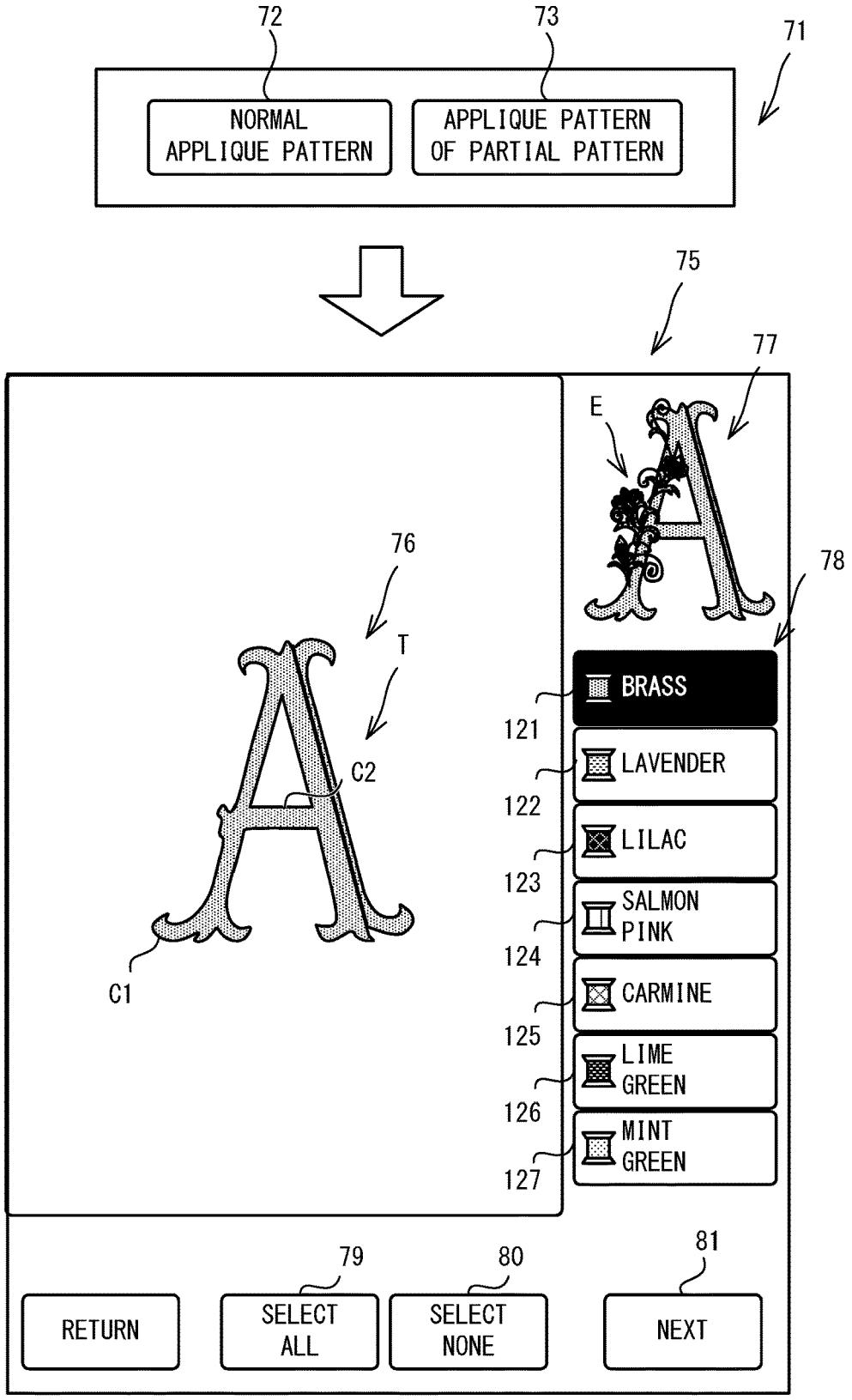
FIG. 4 is an explanatory diagram of screens.

As shown in FIG. 2, the CPU 7 acquires the embroidery data D of the embroidery pattern E specified by the start command (step S1). The CPU 7 displays, on the LCD 15, a screen 71 shown in FIG. 4 used to select a generation method of the applique pattern (step S2). As shown in FIG. 4, the screen 71 includes keys 72 and 73. The key 72 is pressed when creating a normal applique pattern that sets the cutting region M on the basis of an outermost contour, of the contours of the embroidery pattern E as a whole, and an offset amount. The key 73 is pressed when specifying the cutting region M in accordance with the target pattern T and the region specification command, and creating the applique pattern. The CPU 7 determines whether the selected key is the key 72, on the basis of an output result of the touch screen 16 (step S3). When the selected key is the key 72 (yes at step S3), the CPU 7 sets the shape of the cutting region M on the basis of the contours of the embroidery pattern E as a whole, using a known method, and performs normal processing to generate the processing data and the sewing data (step S31). The sewing machine 2 outputs the processing data to the cutting device 3, via the communicator 27, and the cutting device 3 cuts out the applique piece Q from the workpiece P on the basis of the output processing data. After the normal processing, the CPU 7 determines, on the basis of a detection result from the start/stop switch 35, whether a sewing command has been detected (step S33). When the sewing command has not been detected (no at step S33), the CPU 7 stands by until the input of the sewing command is detected. The user presses the start/stop switch 35 after mounting the embroidery frame 17 holding the sewing object C. When the sewing command has been detected (yes at step S33), the CPU 7 performs the sewing on the basis of the sewing data and the embroidery data D (step S34).

When the pressing of the key 73 has been detected (no at step S3), the CPU 7 displays, on the LCD 15, a screen 75 used to select the target pattern T of the embroidery pattern E (step S4). As shown in FIG. 4, the screen 75 displays fields 76 to 78, and keys 79 to 81. The field 76 displays the target pattern T of the embroidery pattern E. The field 77 displays the embroidery pattern E based on the embroidery data D. The field 78 displays, in the sewing order from above to below, items 121 to 127 indicating the thread colors of the partial patterns included in the embroidery pattern E. The items 121 to 127 respectively correspond to the thread colors of BRASS, LAVENDER, LILAC, SALMON PINK, CARMINE, LIME GREEN, and MINT GREEN. Of the items 121 to 127, the item 121 of the thread color BRASS of the target pattern T is displayed as an inverse display of white lettering on a black background. The key 79 is pressed when all the partial patterns of the embroidery pattern E are to be selected as the target pattern. The key 80 is pressed when all the partial patterns of the embroidery pattern E are not to be selected as the target pattern. The key 81 is pressed when inputting a command to confirm the target pattern T.

The CPU 7 determines whether, via the touch screen 16, a pattern specification command that selects some of the embroidery pattern E displayed on the LCD 15 as the target pattern T has been acquired (step S5). The user inputs the pattern specification command by pressing the field 78, and the keys 79 and 80, as necessary. The plurality of partial patterns included in the embroidery pattern E according to the present embodiment are divided by thread color, and at step S5, the CPU 7 acquires the pattern specification command that selects, as the target pattern T, the one or more partial patterns specified by the thread color, of the plurality of partial patterns included in the embroidery pattern E displayed on the LCD 15. After inputting the command to select the target pattern T, the user presses the key 81 and inputs the command to confirm the target pattern T. The CPU 7 stands by until the pressing of the key 81 is detected and the pattern specification command is acquired (no at step S5). When the pattern specification command is acquired (yes at step S5), the CPU 7 identifies the target pattern T (step S6). The CPU 7 according to the present embodiment identifies at least some of the embroidery pattern E as the target pattern T, on the basis of the pattern specification command, and the embroidery data D for sewing the embroidery pattern E. When the target pattern includes two or more of the partial patterns, the CPU 7 identifies the two or more partial patterns as a single pattern, as the target pattern.

Figure 5:
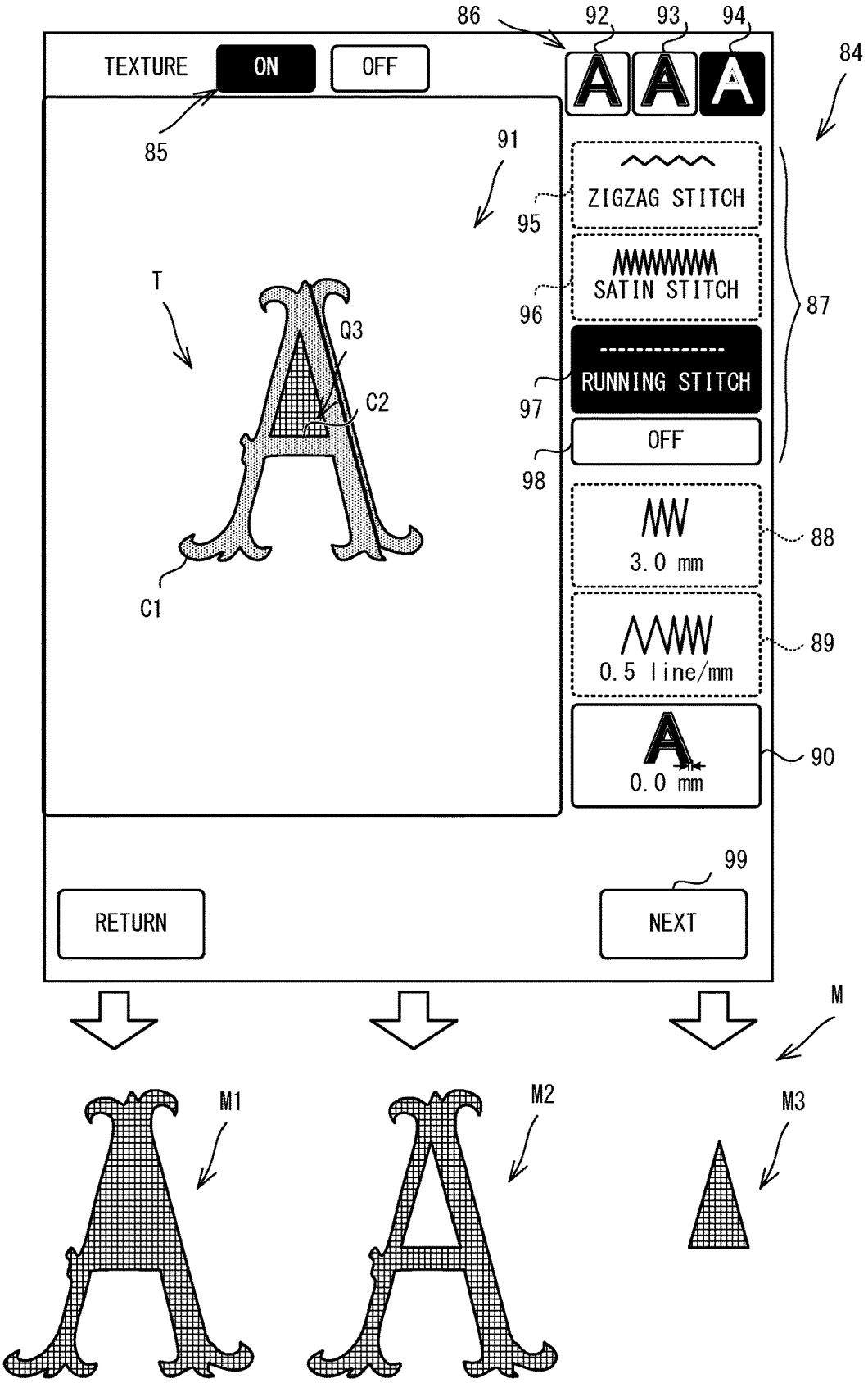
FIG. 5 is an explanatory diagram of a screen and cutting regions set with respect to a target pattern.

The CPU 7 displays, on the LCD 15, a screen 84 shown in FIG. 5 that is used to set conditions of the cutting region M (step S7). As shown in FIG. 5, the screen 84 includes fields 85 to 91, and keys 92 to 99. The field 85 is a field for switching ON or OFF whether to display, in the field 91, the applique piece Q3 corresponding to the cutting region M that accords with a setting in the field 86. In the field 85, of the settings ON and OFF, the currently selected ON is displayed as an inverse display of white lettering on a black background. The field 86 displays the keys 92 to 94 for selecting the region specification command. The key 92 is pressed when selecting the second command as the region specification command. The key 93 is pressed when selecting the third command as the region specification command. The key 94 is pressed when selecting the first command as the region specification command. Of the keys 92 to 94, the currently selected key 94 is displayed as an inverse display of white lettering on a black background. The field 87 displays the keys 95 to 98 for selecting a type (refer to FIG. 7) of fixing stitch N2 to be used to sew the applique piece Q onto the sewing object C. The sewing machine 2 according to the present embodiment can change the stitches that can be selected, depending on the region specification command. When one of the second command or the third command is selected as the region specification command, it is possible to select, as the fixing stitch, the zigzag stitch of the key 95, the satin stitch of the key 96, or no stitch (OFF) of the key 98. When the first command is selected as the region specification command, it is possible to select, as the fixing stitch, the running stitch of the key 97, or no stitch (OFF) of the key 98. The no stitch (OFF) of the key 98 is selected, for example, when it is not necessary to sew the applique piece Q onto the sewing object C, such as when adhering the applique piece Q to the sewing object C or the like. The fields 88 and 89 are fields for setting a stitch width and a stitch density when, as the region specification command, one selected from the group of the second region M1 and the third region M2 is selected. The field 90 is a field for setting an offset amount of the cutting region M. The field 91 is a field that displays the target pattern T and the applique piece Q3 set on the target pattern T. When the setting of the field 85 is ON, the applique piece Q3 is displayed so as to be to the front of the target pattern T. The key 99 is pressed when ending the setting of the conditions of the cutting region M.

The CPU 7 determines, on the basis of a detection result of the touch screen 16, whether the pressing of one selected from the group of the keys 92 to 94 has been detected (step S8). When the pressing of one selected from the group of the keys 92 to 94 has been detected (yes at step S8), the CPU 7 acquires the command selected via the touch screen 16, of the first command, the second command, and the third command, as the region specification command, and identifies the cutting region M corresponding to the acquired region specification command (step S9). Specifically, when the pressing of the key 92 has been detected (yes at step S8), the CPU 7 identifies the second region M1 as the cutting region M. When the pressing of the key 93 has been detected (yes at step S8), the CPU 7 identifies the third region M2 as the cutting region M. When the pressing of the key 94 has been detected (yes at step S8), the CPU 7 identifies the first region M3 as the cutting region M. The CPU 7 identifies the contours C1 and C2 of the target pattern T that define the shape of the cutting region M identified at step S9, and an offset contour (step S10). The CPU 7 identifies the contours C1 and C2 on the basis of line segments joining the needle drop points of the target pattern T in the sewing order. As long as a distance between the line segments is within a predetermined distance, the CPU 7 identifies the contours C1 and C2 while considering the line segments to be stitches in the same region. It is sufficient that the predetermined distance be set as appropriate, and is 1 mm, for example. When the cutting region M is the second region M1, the CPU 7 identifies the outer contour C1 of the target pattern T and identifies the offset contour positioned to the outside or the inside of the outer contour C1 by an offset amount. When the cutting region M is the third region M2, the CPU 7 identifies the outer contour C1 and the inner contour C2 of the target pattern T, and identifies the offset contour positioned to the outside or the inside of each of the outer contour C1 and the inner contour C2 by the offset amount. When the cutting region M is the first region M3, the CPU 7 identifies the inner contour C2 of the target pattern T, and identifies the offset contour positioned to the outside or the inside of the inner contour C2 by the offset amount. The offset amount may be set in advance in accordance with the type of the region specification command, or a setting by the user may be received.

The CPU 7 generates the processing data for cutting out, from the workpiece P, the cutting region M commanded by the region specification command as the applique piece Q (step S21). The processing data includes coordinate data indicating the shape of the offset contour identified at step S10. The processing data is, for example, one selected from the group of the cutting data, drawing data, print data, or the sewing data. The type of the processing data may be set as necessary in accordance with the devices included in the system 1. The type of the processing data may be automatically set in accordance with the devices included in the system 1, or may be set by the user. The cutting data is data for cutting the workpiece P using the cutting device 3 to which the cutting blade is mounted. The drawing data is data for drawing on the workpiece P, using a writing tool, using the cutting device 3 to which the writing tool is mounted. The print data is data for printing using a print device. The system 1 is provided with the cutting device 3, and thus, in the present embodiment, the CPU 7 generates the cutting data as the processing data. When the processing data is the drawing data or the print data, the user obtains the applique piece Q by cutting the workpiece P along lines drawing by the cutting device 3 or along lines printed by the print device. When the processing data is the sewing data, the user obtains the applique piece Q by cutting the workpiece P along stitches sewn by the sewing machine 2. As a result of the above-described processing, when the offset amount is set, the CPU 7 generates the processing data for cutting, from the workpiece P, the cutting region M that has been expanded or reduced by the offset amount on the basis of the contours C1 and C2 of the target pattern T identified at step S10 and the acquired offset amount.

Figure 7:
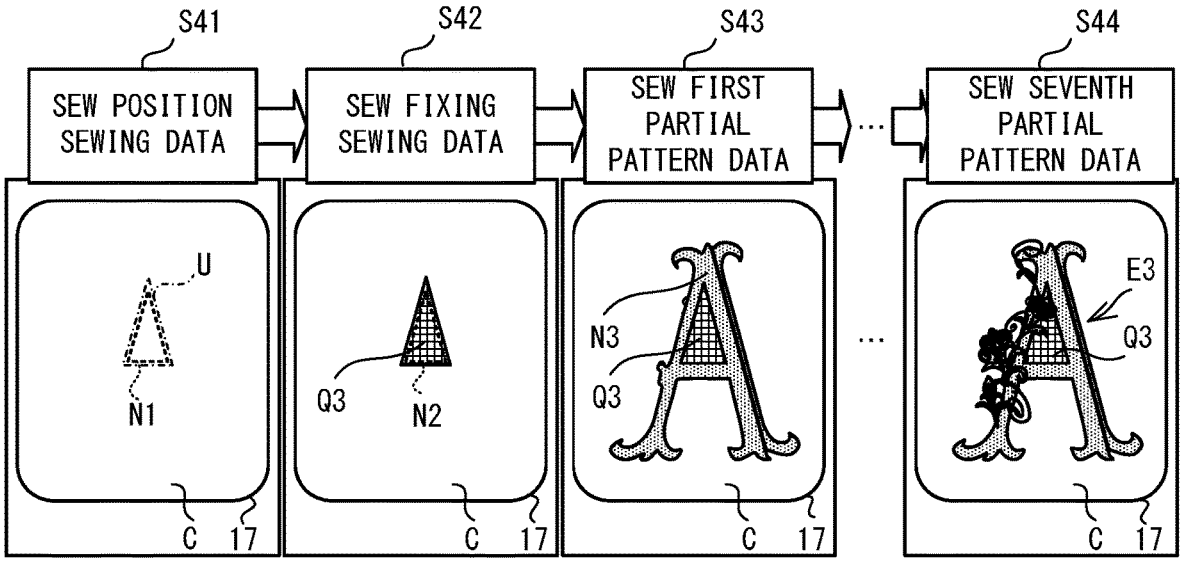
FIG. 7 is an explanatory diagram of a process for sewing the applique pattern according to a third specific example.

The CPU 7 generates position sewing data for forming, using the sewing machine 2, position stitches N1 shown in FIG. 7 that indicate an arrangement, on the sewing object C, of the applique piece Q cut out from the workpiece P in accordance with the processing data, and generates fixing sewing data for sewing the applique piece Q to the sewing object C using the sewing machine 2 (step S22). The position sewing data includes coordinate data for forming the position stitches N1 at a predetermined distance to the inside from the contour of the cutting region M. The fixing sewing data includes coordinate data for forming the fixing stitches N2 of the type specified in the field 87 on the basis of the contour of the cutting region M and stitch conditions. The predetermined distance takes into account the external appearance and the like of the applique pattern, and may be set as appropriate. The predetermined distance may be a value that is automatically set depending on the type of the region specification command, may be the same value regardless of the type of the region specification command, or may be set by the user. The predetermined distance may be the same for the position stitches N1 and the fixing stitches N2, or the predetermined distances may be mutually different. On the basis of the processing data generated at step S21, the CPU 7 displays, on the LCD 15, a preview screen that includes the shape of the cutting region M (step S23). In the field 91 shown in FIG. 5, the preview screen is displayed for a case in which, for the third specific example, with respect to the target pattern T, the region specification command is the first command, the fixing stitches are the running stitch, and the offset amount is 0 mm. On the basis of a detection result of the touch screen 16, the CPU 7 determines whether the pressing of the key 99 has been detected (step S24). When the pressing of the key 99 has not been detected (no at step S24), the CPU 7 returns the processing to step S8.

When the pressing of one selected from the group of the keys 92 to 94 has not been detected (no at step S8), on the basis of a detection result of the touch screen 16, the CPU 7 determines whether a setting of the offset amount of field 90 has been detected (step S11). When the setting of the offset amount has been detected and the offset amount that expands or reduces the cutting region M has been acquired (yes at step S11), the CPU 7 identifies the acquired offset amount (step S12). The CPU 7 identifies the contour of the currently selected cutting region M, and identifies the offset contour on the basis of the identified contour and the offset amount identified at step S12 (step S10). When the setting of the offset amount has not been detected (no at step S11), on the basis of a detection result of the touch screen 16, the CPU 7 determines whether the setting of the stitch conditions in the fields 88 and 89 has been detected (step S14). When the setting of the stitch conditions has been detected (yes at step S14), the CPU 7 identifies the set stitch conditions (step S15). The CPU 7 identifies the contour of the currently selected cutting region M, and identifies the offset contour on the basis of the identified contour, and the currently set offset amount (step S10). When the setting of the stitch conditions has not been detected (no at step S14), the CPU 7 performs processing at step S24.

Figure 6:
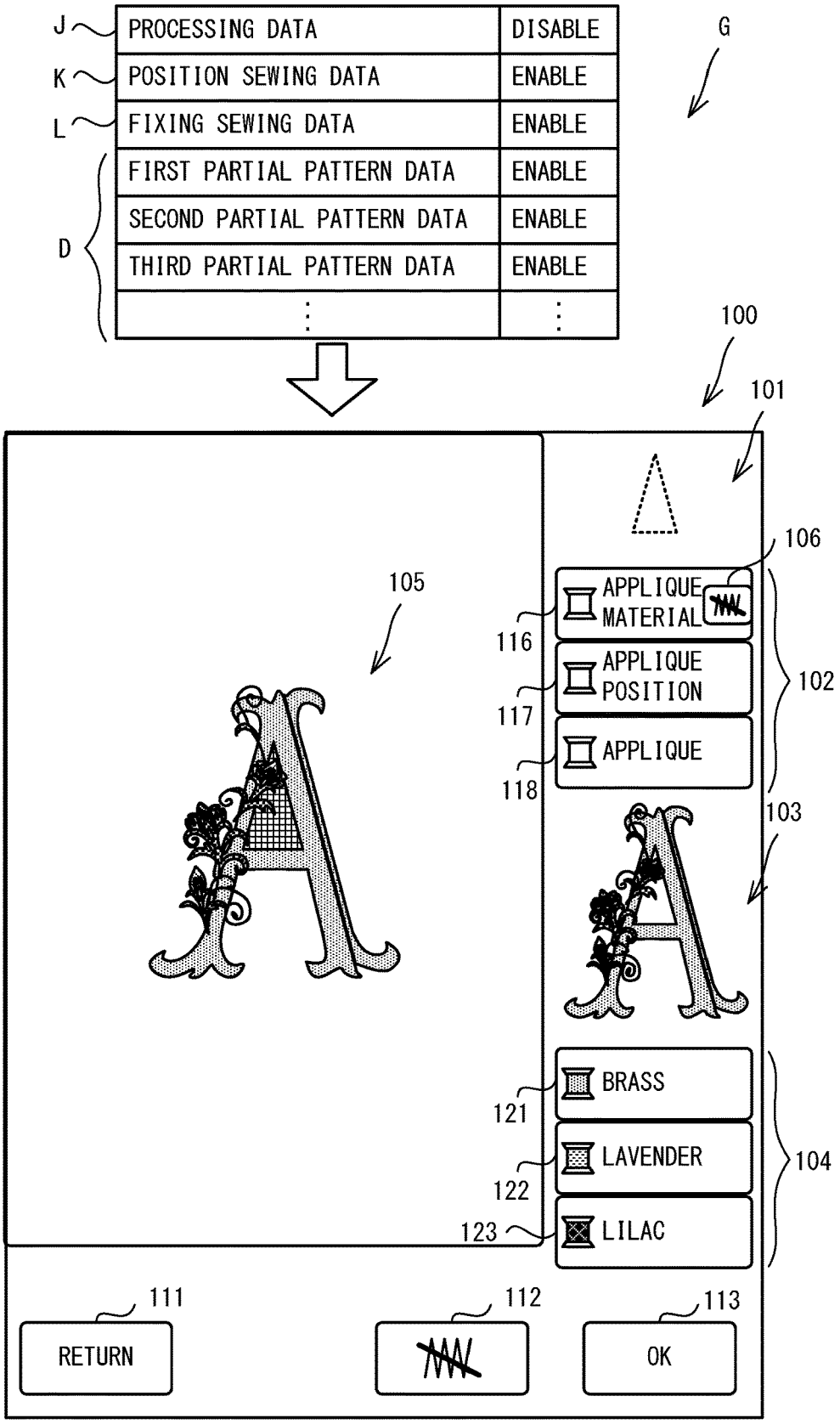
FIG. 6 is an explanatory diagram of applique pattern data and a screen.

The user checks the preview screen in the field 91, and presses the key 99 to end the setting of the conditions of the cutting region M. When the pressing of the key 99 has been detected (yes at step S24), when the region specification command is the first command, the CPU 7 enables target data, of the embroidery data, for sewing the target pattern T, and when the region specification command is the second command or the third command, disables the target data of the embroidery data D and generates applique pattern data G (step S25). As shown in FIG. 6, the applique pattern data G of the third specific example includes processing data J generated at step S21, position sewing data K and fixing sewing data L generated at step S22, and the embroidery data D acquired at step S1. Enable/disable settings are associated with the processing data J, the position sewing data K, and the fixing sewing data L, and each of the partial pattern data in the embroidery data D. In the third specific example, the enable/disable setting for the processing data is set to disable. Although not shown in the drawings, in the first specific example and the second specific example, the enable/disable settings for the processing data and for the partial pattern data that is first in the sewing order are set to disable.

The CPU 7 displays, on the LCD 15, a screen 100 for checking the applique pattern data G (step S26). The screen 100 displays fields 101 to 105, and keys 111 to 113. The field 101 displays the shape of the applique piece Q corresponding to the cutting region M, on the basis of the processing data J. The field 102 displays settings of items 116 to 118. The item 116 indicating APPLIQUE MATERIAL displays enable/disable settings of the thread colors and the processing data when sewing stitches indicating the contour of the cutting region M in accordance with the processing data of the applique pattern data G. In the third specific example, a mark 106, which indicates that the enable/disable setting is set to disable, is displayed in the item 116. The item 117 indicating APPLIQUE POSITION displays enable/disable settings of the thread colors and the sewing data when sewing the position stitches N1 representing the arrangement of the applique piece Q on the sewing object C in accordance with the position sewing data K of the applique pattern data G. The item 118 indicating APPLIQUE displays enable/disable settings for the thread colors and the partial pattern data when sewing the fixing stitches N2 for sewing the applique piece Q to the sewing object C in accordance with the fixing sewing data L of the applique pattern data G. The field 103 displays the embroidery pattern E based on the embroidery data D. The field 104 displays enable/disable settings for the thread colors and the partial pattern data when sewing stitches in accordance with the partial pattern data, for each of the items 121 to 127. Only the items 121 to 123 are displayed in the field 104, of the items 121 to 127, and the items 124 to 127 can be displayed in the field 104 by scrolling the field 104. In the third specific example, the mark 106, which indicates that the enable/disable setting is set to disable, is not displayed in the items 117 and 118, and in each of the partial pattern data. The key 111 is pressed when displaying the screen 84 and resetting the settings for the conditions of the cutting region M. The key 112 is pressed when changing the enable/disable settings for the items 116 to 118 displayed in the field 102, and for the items 121 to 127 displayed in the field 104. The key 113 is pressed when ending the checking of the applique pattern data G.

The CPU 7 determines whether the pressing of the key 113 has been detected (step S27). When the pressing of the key 113 has not been detected (no at step S27), the CPU 7 determines whether the pressing of the key 112 has been detected (step S28). For example, when fixing the applique piece Q to the sewing object C using adhesive or the like, the user presses the key 112 in a state in which the item 118 is selected to change the enable/disable setting of the item 118 to disable. For example, when wishing to sew the target pattern T, the user selects the second command or the third command as the region specification command, presses the key 112 in a state in which the item 121 corresponding to the target pattern T is selected, and changes the enable/disable setting for the item 121 to enable. When the pressing of the key 112 has been detected (yes at step S28), the CPU 7 changes the enable/disable setting of the items selected, of the items of the fields 102 and 104, and updates the screen 100 displayed on the LCD 15 (step S29). When the pressing of the key 112 has not been detected (no at step S28), the CPU 7 determines whether the pressing of the key 111 has been detected (step S30). When the pressing of the key 111 has been detected (yes at step S30), the CPU 7 returns the processing to step S7. When the pressing of the key 111 has not been detected (no at step S30), or subsequent to step S29, the CPU 7 returns the processing to step S27.

When the pressing of the key 113 has been detected (yes at step S27), the CPU 7 outputs the processing data J, of the applique pattern data G, to the cutting device 3 via the communicator 27. The CPU 51 of the cutting device 3 receives the processing data J, drives the cutting portion 60 on the basis of the processing data, and cuts out the applique piece Q from the workpiece P. The CPU 7 determines, on the basis of a detection signal of the start/stop switch 35, whether the sewing start command has been detected (step S33). When the sewing start command has not been detected (no at step S33), the CPU 7 stands by until the sewing start command has been detected. When the sewing start command has been detected (yes at step S33), the CPU 7 performs the sewing on the basis of the data, of the applique pattern data G, for which the enable/disable setting is set to enable (step S34).

Sewing processing in the case of the third specific example will be described with reference to FIG. 6 and FIG. 7. As shown in FIG. 7, since the enable/disable setting of the processing data J, of the applique pattern data G, is set to disable, the CPU 7 does not perform the sewing on the basis of the processing data J. Since the enable/disable setting of the position sewing data K is set to enable, the CPU 7 drives the movement mechanism 10 and the sewing portion 9 in accordance with the position sewing data K to sew the position stitches N1 representing the position of the applique piece Q3 on the sewing object C (step S41). The position stitches N1 are formed on the inside, by the predetermined distance, of the contour of the applique piece Q3 disposed at the sewing position, as shown by an alternate long and short dash line U. After the sewing of the position sewing data K, the CPU 7 may drive the movement mechanism 10 and, after disposing the embroidery frame 17 at a position separated from the needle bar 8, may display a message on the LCD 15 prompting the applique piece Q3 cut out by the cutting device 3 in accordance with the processing data to be arranged at the position represented by the position stitches N1.

After arranging the applique piece Q3 cut out by the cutting device 3 in accordance with the processing data J at the position represented by the position stitches N1, the user presses the start/stop switch 35 to command the start of the sewing based on the fixing sewing data L. The applique piece Q3 is, for example, adhered to the sewing object C using an adhesive for the sewing object C or the like. In response to detecting the pressing of the start/stop switch 35, the CPU 7 drives the movement mechanism 10 and the sewing portion 9 in accordance with the fixing sewing data L to sew the applique piece Q3 onto the sewing object C using the fixing stitches N2 (step S42). The fixing stitches N2 are formed on the inside, by the predetermined distance, of the contour of the applique piece Q3. Since the enable/disable setting of the sewing data of a first partial pattern, which is the target pattern T in the third specific example, is set to enable, the CPU 7 displays, on the LCD 15, a message prompting an upper thread to be replaced with a thread of the thread color "BRASS" of the partial pattern that is first in the sewing order. After replacing the upper thread with the thread of the thread color of the partial pattern that is first, the user presses the start/stop switch 35.

In response to detecting the pressing of the start/stop switch 35, the CPU 7 performs sewing based on the partial pattern data that is first in the sewing order (step S43). By the processing at step S43, the CPU 7 drives the sewing portion 9 in accordance with the embroidery data D to sew the target pattern T on the sewing object C on which is arranged the applique piece Q3 cut out in accordance with the processing data. The fixing stitches N2 are covered by stitches N3 of the target pattern T. The sewing is performed in a similar manner for the partial pattern data that are second to seventh in the sewing order (step S44). As a result of the sewing processing, the applique pattern E3 is sewn. As shown in FIG. 2, the CPU 7 ends the main processing here. In the sewing processing in the case of the first specific example and the second specific example, the same processing is basically performed as the sewing processing in the case of the third specific example, but when the enable/disable settings of the applique pattern data remain as being set to disable, the sewing processing based on the partial pattern data of the target pattern T is not performed. In the sewing processing in the case of the first specific example and the second specific example also, when the enable/disable settings of the applique pattern data are changed from disable to enable (yes at step S28, step S29), some or all of the sewing processing based on the partial pattern data of the target pattern T may be performed.

When the main processing shown in FIG. 2 is performed by the device 4, the processing at step S27 may be changed, and it is sufficient that the processing at step S33 and step S34 be performed by the sewing machine 2. When the pressing of the key 113 has been detected by the processing at step S27 (step S27), via the communicator 45, the CPU 41 of the device 4 outputs the applique pattern data G to the sewing machine 2 and outputs the processing data J to the cutting device 3. The cutting device 3 performs processing to cut out the applique piece Q3 from the workpiece P, on the basis of the processing data J output from the device 4. The sewing machine 2 performs the processing at step S33 and step S34, on the basis of the applique pattern data G output from the device 4.

Figure 8:
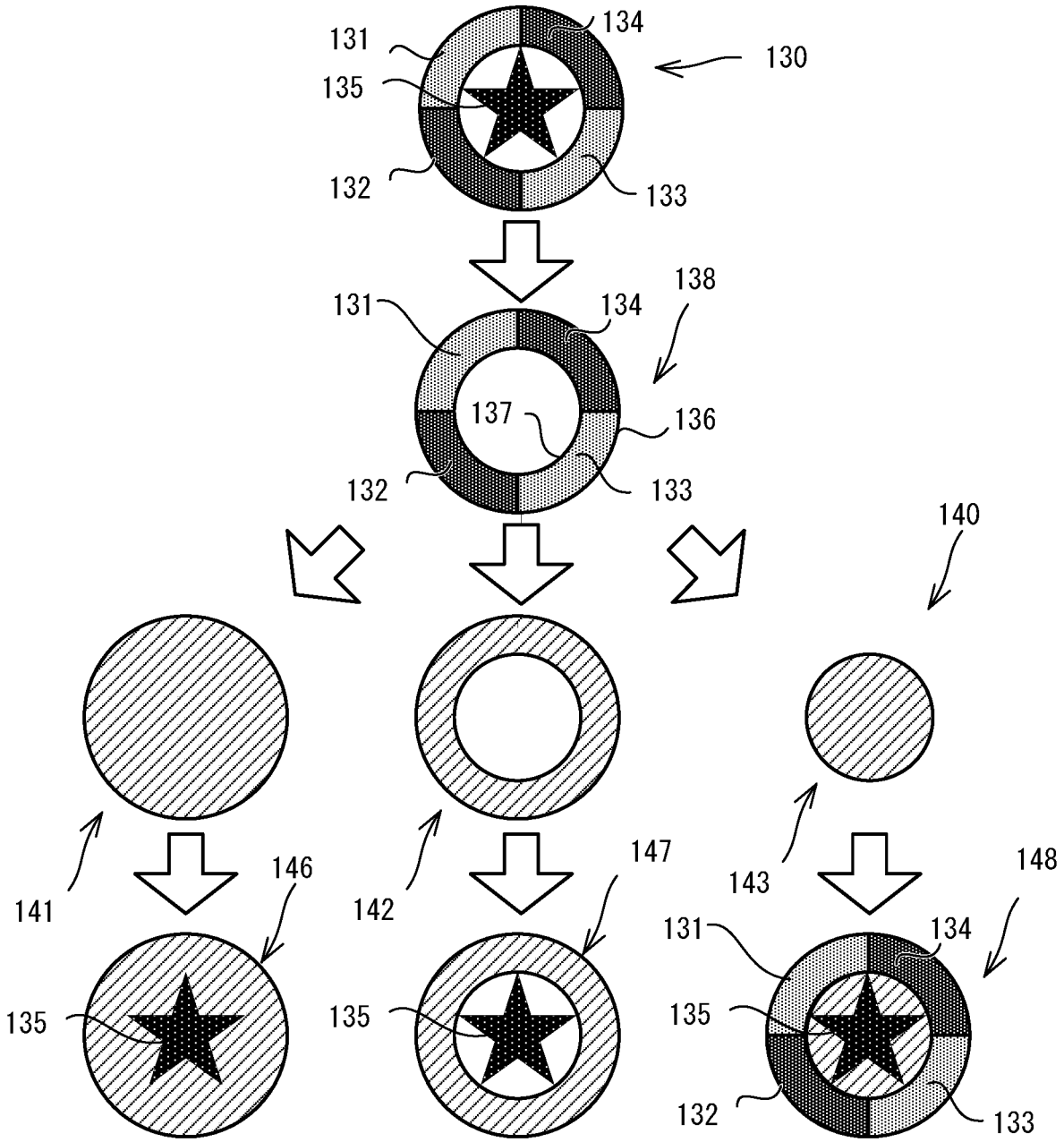
FIG. 8 is an explanatory diagram of a process for setting the cutting region with respect to the target pattern formed of partial patterns, and creating an applique pattern.

An outline of the main processing for an embroidery pattern 130 of fourth to sixth specific examples will be described with reference to FIG. 8. The embroidery pattern 130 of the fourth to sixth specific examples includes partial patterns 131 and 133 sewn using a first color thread, partial patterns 132 and 134 sewn using a second color thread, and a partial pattern 135 sewn using a third color thread. When, of the partial patterns 131 to 135, the partial patterns 131 to 134 are identified as the target pattern (yes at step S5), the CPU 7 treats the partial patterns 131 to 134 as the single pattern, and identifies the single pattern as a target pattern 138 (step S6). In the fourth specific example, when the pressing of the key 92 at step S8 has been detected (yes at step S8), the CPU 7 identifies a second region 141 as the cutting region (step S9). In the fifth specific example, when the pressing of the key 93 has been detected (yes at step S8), the CPU 7 identifies a third region 142 as the cutting region (step S9). In the sixth specific example, when the pressing of the key 94 has been detected (yes at step S8), the CPU 7 identifies a first region 143 as the cutting region (step S9). At step S21, the CPU 7 generates the processing data in which the two or more of the partial patterns, the partial patterns 131 to 134, are considered to be the single pattern. In the fourth specific example, at step S34, the CPU 7 generates an applique pattern 146 by sewing the partial pattern 135 without sewing the partial patterns 131 to 134, on the basis of the applique pattern data. In the fifth specific example, at step S34, the CPU 7 generates an applique pattern 147 by sewing the partial pattern 135 without sewing the partial patterns 131 to 134, on the basis of the applique pattern data. In the sixth specific example, at step S34, the CPU 7 generates an applique pattern 148 by sewing the partial patterns 131 to 135, on the basis of the applique pattern data.

The sewing machine 2 of the above-described embodiment is provided with the touch screen 16, and the CPU 7 to which the detection signal of the touch screen 16 is input. The CPU 7 performs pattern identification processing (step S6) to identify the target pattern T. The CPU 7 performs region specification acquisition processing (step S8), to acquire the region specification command that, via the touch screen 16, selects, as the cutting region M, the first region M3 surrounded by the outside of the target pattern T and by the target pattern T. The CPU 7 performs processing data generation processing that generates the processing data for cutting the cutting region M specified by the region specification command, as the applique piece Q3, from the workpiece P (step S21). The sewing machine 2 contributes to generating the processing data for cutting the first region M3 from the workpiece P. The user can acquire the applique piece Q3 that corresponds to the cutting region M, by processing the workpiece P on the basis of the processing data. The user can obtain the applique pattern E3, in which the applique piece Q3 corresponding to the cutting region M and the target pattern T are combined, more easily than in the known art. In other words, compared to the known art, the sewing machine 2 contributes to improving the convenience for the user when creating the applique pattern E3 having the different shape from the target pattern T, on the basis of the contours C1 and C2 of the target pattern T.

In the pattern identification processing at step S6, the CPU 7 identifies at least a part of the embroidery pattern E as the target pattern T, on the basis of the embroidery data D for sewing the embroidery pattern E. By utilizing the existing embroidery data D stored in the storage 24, the sewing machine 2 further contributes to improving the convenience for the user when creating the applique pattern E3 having the different shape from the target pattern T, on the basis of the contours C1 and C2 of the target pattern T.

In the region specification acquisition processing at step S8, the CPU 7 acquires, as the region specification command, the command selected via the touch screen 16 from among the first command for which the first region M3 is the cutting region M, the second command for which the second region M1, which is surrounded by the outer contour C1 that is the contour of the target pattern T separated from the first region M3 and which includes the first region M3, is the cutting region M, and the third command for which the third region M2, which is obtained by excluding the first region M3 from the second region M1, is the cutting region M. The sewing machine 2 contributes to changing the cutting region M set on the basis of the contours C1 and C2 of the target pattern T, in accordance with the command selected via the touch screen 16. The sewing machine 2 further contributes to improving the convenience for the user when creating the applique patterns E1 to E3 having the different shape from the target pattern T, compared to a device on which the cutting region M set on the basis of the contours C1 and C2 of the target pattern T cannot be selected.

When the region specification command is the first command, the CPU 7 enables the target data for sewing the target pattern T, of the embroidery data D, and when the region specification command is the second command or the third command, the CPU 7 performs setting processing to disable the target data of the embroidery data D (step S25). The sewing machine 2 contributes to automatically setting whether to cause the target data to be disabled or enabled, in accordance with the region specification command. The sewing machine 2 contributes to omitting time and effort required for the user to manually perform the enable/disable setting.

The CPU 7 performs offset amount acquisition processing (step S11) to acquire the offset amount to expand or reduce the cutting region M. In the processing data generation processing at step S21, the CPU 7 generates the processing data J for cutting, from the workpiece P, the cutting region M that has been expanded or reduced by the offset amount, on the basis of the contours C1 and C2 of the target pattern T identified at step S10 and the offset amount acquired at step S11. The sewing machine 2 contributes to expanding or reducing the cutting region M by the offset amount. The sewing machine 2 contributes to generating the processing data that takes into account a seam allowance of the applique piece Q3, suppression of curling up of end portions, a balance of a finished appearance, and the like. Compared to a device that cannot set the offset amount, the sewing machine 2 further contributes to improving the convenience for the user when creating the applique pattern E3 having the different shape from the target pattern T.

The sewing machine 2 is provided with the LCD 15. On the basis of the processing data, the CPU 7 performs preview processing (step S23) that displays, on the LCD 15, the preview screen including the shape of the cutting region M, and re-acquisition processing (step S12 after step S23), after the preview processing, to acquire the offset amount of the cutting region M, which is input via the touch screen 16. The sewing machine 2 contributes to expanding or reducing the cutting region M by the offset amount. The sewing machine 2 contributes to generating the processing data that takes into account the seam allowance of the applique piece Q3, the suppression of curling up of the end portions, the balance of the finished appearance, and the like. Compared to a device that cannot set the offset amount, the sewing machine 2 contributes to expanding or reducing the cutting region M by the offset amount when creating the applique pattern E3 having the different shape from the target pattern T. The user can adjust the offset amount while taking into account the sewing on of the applique piece Q3, the finish and the like, while referring to the LCD 15. Compared to a device that cannot set the offset amount, the sewing machine 2 further contributes to improving the convenience for the user when creating the applique pattern E3 having the different shape from the target pattern T.

The CPU 7 performs position sewing data generation processing (step S22) that generates the position sewing data K for forming, using the sewing machine 2, the position stitches N1 indicating the arrangement, on the sewing object, of the applique piece Q3 cut out from the workpiece P in accordance with the processing data J. The sewing machine 2 contributes to generating the position sewing data K. As a result of the sewing machine 2 sewing, in accordance with the position sewing data K, the position stitches N1 indicating the arrangement, on the sewing object C, of the applique piece Q3, positioning of the applique piece Q3 is easily performed. Compared to a device that cannot generate the position sewing data K, the sewing machine 2 further contributes to improving the convenience for the user when creating the applique pattern E3 having the different shape from the target pattern T.

The CPU 7 performs fixing sewing data generation processing (step S22) that generates the fixing sewing data for using the sewing machine 2 to sew, to the sewing object C, the applique piece Q cut from the workpiece P in accordance with the processing data J. The sewing machine 2 contributes to sewing the applique piece Q3 to the sewing object C in accordance with the fixing sewing data L. Compared to the device that cannot generate the fixing sewing data L, the sewing machine 2 further contributes to improving the convenience for the user when creating the applique pattern E3 having the different shape from the target pattern T.

On the basis of the embroidery data D, the CPU 7 performs display control processing (step S4) to display the embroidery pattern E on the LCD 15, and pattern specification command acquisition processing (step S5) to acquire the pattern specification command that selects, via the touch screen 16, a part of the embroidery pattern E displayed on the LCD 15, as the target pattern T. In the pattern identification processing at step S6, the CPU 7 identifies a part of the embroidery pattern E specified by the pattern specification command as the target pattern T. The sewing machine 2 contributes to acquiring, as the target pattern T, the part of the embroidery pattern E displayed on the LCD 15. The sewing machine 2 contributes to improving the convenience for the user when inputting the pattern specification command.

The embroidery pattern 130 of the fourth specific example includes the plurality of partial patterns 131 to 135. In the pattern specification command acquisition processing (step S6), the CPU 7 acquires the pattern specification command that selects, as the target pattern T, one or more of the partial patterns 131 to 134, of the plurality of partial patterns. In the processing data generation processing at step S21, the CPU 7 generates the processing data on the basis of the contour of the target pattern 138, as the single pattern formed of the two or more of the partial patterns, the partial patterns 131 to 134. Compared to a device that cannot generate the processing data on the basis of the contour of the target pattern 138, as the single pattern formed of the two or more of the partial patterns, the partial patterns 131 to 134, the sewing machine 2 further contributes to improving the convenience for the user when creating the applique pattern 148 having the different shape from the target pattern 138.

The plurality of partial patterns included in the embroidery pattern E are divided by thread color. In the pattern specification command acquisition processing at step S5, the CPU 7 acquires the pattern specification command that selects, as the target pattern T, the one or more partial patterns specified by the thread color, of the plurality of partial patterns included in the embroidery pattern E displayed on the LCD 15. The sewing machine 2 contributes to selecting the partial patterns that form the target pattern T, by the user selecting the thread colors. Compared to a device that cannot select the partial pattern using the thread color, the sewing machine 2 further contributes to improving the convenience for the user when creating the applique pattern E3 having the different shape from the target pattern T.

The sewing machine 2 is provided with the sewing portion 9 configured to form the stitches on the sewing object C in accordance with the embroidery data D. The CPU 7 drives the sewing portion 9 in accordance with the embroidery data D, and sews the target pattern T on the sewing object C, on which is arranged the applique piece Q3 cut out in accordance with the processing data (step S34, step S43). The sewing machine 2 contributes to more easily obtaining, compared to known art, the applique pattern E3 in which the applique piece Q3 and the embroidery pattern E are combined.

The CPU 7 drives the sewing portion 9 in accordance with the position sewing data K and performs position sewing processing (step S41) to form, on the sewing object C, the position stitches N1 indicating the position of the applique piece Q3. The user easily positions the applique piece Q3 using the position stitches N1 as a marker. The CPU 7 drives the sewing portion 9 in accordance with the fixing sewing data L, and performs fixing sewing processing (step S42) to sew the applique piece Q3 onto the sewing object C. The sewing machine 2 contributes to reliably sewing the applique piece Q3 onto the sewing object C.

The processing data generation device, the embroidery sewing machine, and the non-transitory computer-readable storage medium according to the present disclosure are not limited to the above-described embodiment, and various modifications may be added insofar as they do not depart from the scope and gist of the present disclosure. For example, the following modifications may be added as appropriate.

The present disclosure can be implemented in various modes, and, for example, may be realized in a format of a processing data generation method or the like that is executed by the control portion of the processing data generation device.

(A) The configuration of the sewing machine 2 may be changed as appropriate. As long as the sewing machine 2 is able to perform embroidery sewing, the sewing machine 2 may be an industrial sewing machine, and may be a multi-needle sewing machine provided with a plurality of needle bars. When the sewing machine 2 is the multi-needle sewing machine, the number of needle bars is not particularly limited. The configuration of the device 4 may be changed as appropriate, and the device 4 may be the cutting device 3, a smartphone, or the like, for example. It is sufficient that the display portion of the sewing machine 2 or the processing data generation device 4 be able to display an image, and the display portion may be, for example, an organic EL display, a plasma display, a plasma tube array display, an electronic paper device utilizing electrophoresis, or the like. In addition to a touch screen, a keyboard, and a mouse, the input portion of the sewing machine 2 or the processing data generation device 4 may be a switch, a joystick, or the like. The communicator of at least one selected from the group of the sewing machine 2, the cutting device 3, and the device 4 may be changed or omitted, and, for example, some or all of the data including the embroidery data, the processing data, and the applique pattern data may be transmitted and received by wired communication, or may be transferred via a storage medium.

The program including the instructions to execute the processing shown in FIG. 2 may be stored in a storage device of each device until the program is executed by the CPU 7 or the CPU 41. Thus, a program acquisition method, an acquisition path, and a device storing the program may be changed, respectively, as appropriate. The program executed by the control unit 30 may be received from another device via cable or wireless communication, and may be stored in a storage device, such as a flash memory or the like. The other device includes a PC, and a server connected via a network, for example.

Each of the steps of the main processing is not limited to the example of being executed by the CPU 7 or the CPU 41, and part or all of the processing may be executed by another electronic device (an ASIC, for example). Each of the steps of the main processing may be executed by distributed processing by a plurality of electronic devices (a plurality of CPUs, for example). The order of each of the steps of the main processing may be changed, the step may be omitted, or a step may be added, as necessary. For example, the following changes may be added to the main processing as appropriate.

In place of the embroidery data D at step S1, graphic data representing one or more graphics may be acquired. In this case, the target pattern may be identified from among the one or more graphics. For example, the CPU 7 can identify regions filled with color, of the graphics, as sewing regions in which the stitches are to be formed, and can perform processing that is the same as the main processing shown in FIG. 2, by, either before or after identifying the target pattern, converting to embroidery data for sewing the sewing regions using predetermined stitches, such as satin stitch, fill stitch, practical pattern stitch, and the like.

The region specification command may be the first command, or a configuration may be adopted in which one selected from the group of the second and the third command cannot be selected. The sewing machine 2 may be able to select a command other than the first to third commands, in addition to the first command. A configuration may be adopted in which the offset amount cannot be set, and the offset amount may be a fixed value. The processing at step S25 may be omitted. In this case, a configuration may be adopted in which the enable/disable settings can be set manually at step S28 and step S29. The CPU 7 may perform the processing at step S25, and may omit the processing at step S28 and step S29. The preview processing that includes the shape of the cutting region M may be omitted. A configuration may be adopted in which the stitch conditions can be set to the same conditions regardless of the region specification command. A configuration may be adopted in which the stitch conditions cannot be set by the user. The fixing stitches N2 when the region specification command is the first command need not necessarily be partially or totally covered by the stitches N3 of the target pattern T. The CPU 7 may receive editing to change the stitch conditions of the target pattern, in place of the enable/disable settings of the target pattern. In this case, the stitch conditions may include, for example, a type of the stitches, such as the satin stitch, the fill stitch, the practical pattern stitch, and the like, and the thread density. In this type of case, even when the region specification command is the second command or the third command, for example, the sewing machine 2 can set the stitch conditions such that the target pattern T can be seen from between the applique pieces Q1 and Q2, and can increase variations in the applique pattern. When the region specification command is the second command, in accordance with the enable/disable settings, stitches representing the inner contour C2 of the target pattern T may be formed while omitting the processing to perform the sewing in accordance with the partial pattern data corresponding to the target pattern T.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A processing data generation device comprising:

an input portion;

a processor configured to receive a detection signal of the input portion; and a memory configured to store computer-readable instructions that, when executed by the processor, instruct the processor to perform processes comprising:

pattern identification processing of identifying a target pattern;

notification processing of notifying options of a region specification command to select a cutting region, the options including:

a first command in which a first region is the cutting region, a second command in which a second region is the cutting region, the second region being surrounded by an outer contour, the outer contour being a contour, of the target pattern, separated from the first region, and the second region including the first region, and a third command in which a third region is the cutting region, the third region being obtained by excluding the first region from the second region;

region specification command acquisition processing of acquiring, via the input portion, the region specification command selected from among the options; and processing data generation processing of creating processing data for cutting out, from a workpiece to be cut, the cutting region specified by the region specification command, as an applique piece.

2. The processing data generation device according to claim 1, wherein the pattern identification processing includes identifying, based on embroidery data for sewing an embroidery pattern, at least a part of the embroidery pattern as the target pattern.

3. The processing data generation device according to claim 2, wherein the computer-readable instructions further instruct the processor to perform a process comprising:

setting processing of enabling target data, which is data for sewing the target pattern, of the embroidery data, when the region specification command is the first command, and disabling the target data, of the embroidery data, when the region specification command is the second command or the third command.

4. The processing data generation device according to claim 2, further comprising:

a display portion, wherein the computer-readable instructions further instruct the processor to perform processes comprising:

display control processing of displaying the embroidery pattern on the display portion, based on the embroidery data; and pattern specification command acquisition processing of acquiring, via the input portion, a pattern specification command to select, as the target pattern, part of the embroidery pattern displayed on the display portion, and the pattern identification processing includes identifying, as the target pattern, the part of the embroidery pattern specified by the pattern specification command.

5. The processing data generation device according to claim 4, wherein the embroidery pattern includes a plurality of partial patterns, the pattern specification command acquisition processing includes acquiring the pattern specification command to select, as the target pattern, one or more of the partial patterns, of the plurality of partial patterns, and the processing data generation processing includes creating the processing data in which, when the target pattern includes two or more of the partial patterns, the two or more of the partial patterns are assumed to be the single partial pattern.

6. The processing data generation device according to claim 5, wherein the plurality of partial patterns included in the embroidery pattern are divided by thread color, and the pattern specification command acquisition processing includes acquiring the pattern specification command to select, of the plurality of partial patterns included in the embroidery pattern displayed on the display portion, the one or more of the partial patterns specified by the thread color, as the target pattern.

7. The processing data generation device according to claim 1, wherein the computer-readable instructions further instruct the processor to perform a process comprising:

offset amount acquisition processing of acquiring an offset amount to expand or reduce the cutting region, and the processing data generation processing includes creating the processing data for cutting out, from the workpiece, the cutting region expanded or reduced by the offset amount.

8. The processing data generation device according to claim 7, further comprising:

a display portion, wherein the computer-readable instructions further instruct the processor to perform processes comprising:

preview processing of displaying, on the display portion, a preview screen including a shape of the cutting region, based on the processing data; and re-acquisition processing of acquiring the offset amount, of the cutting region, input via the input portion after the preview processing.

9. The processing data generation device according to claim 1, wherein the computer-readable instructions further instruct the processor to perform a process comprising:

position sewing data generation processing of creating position sewing data for forming, using an embroidery sewing machine, stitches indicating a position, on a sewing object, of the applique piece cut out from the workpiece in accordance with the processing data.

10. The processing data generation device according to claim 1, wherein the computer-readable instructions further instruct the processor to perform a process comprising:

fixing sewing data creating processing of creating fixing sewing data for sewing the applique piece cut out from the workpiece in accordance with the processing data, onto a sewing object, using an embroidery sewing machine.

11. An embroidery sewing machine comprising:

an input portion;

a sewing portion having a needle bar, the sewing portion being configured to drive the needle bar to reciprocate in an up-down direction to form stitches on a sewing object, in accordance with embroidery data;

a processor configured to receive a detection signal of the input portion, and to control the sewing portion; and a memory configured to store computer-readable instructions that, when executed by the processor, instruct the processor to perform processes comprising:

pattern identification processing of identifying a target pattern;

notification processing of notifying options of a region specification command to select a cutting region, the options including:

a first command in which a first region is the cutting region, a second command in which a second region is the cutting region, the second region being surrounded by an outer contour, the outer contour being a contour, of the target pattern, separated from the first region, and the second region including the first region, and a third command in which a third region is the cutting region, the third region being obtained by excluding the first region from the second region;

region specification command acquisition processing of acquiring, via the input portion, the region specification command selected from among the options; and processing data generation processing of creating processing data for cutting out, from a workpiece to be cut, the cutting region specified by the region specification command, as an applique piece.

12. The embroidery sewing machine according to claim 11, wherein the pattern identification processing includes identifying, based on embroidery data for sewing an embroidery pattern, at least a part of the embroidery pattern as the target pattern, and the computer-readable instructions further instruct the processor to perform a process comprising:

target pattern sewing processing of driving the sewing portion in accordance with the embroidery data to sew the target pattern on the sewing object on which is arranged the applique piece cut out in accordance with the processing data.

13. The embroidery sewing machine according to claim 11, wherein the computer-readable instructions further instruct the processor to perform processes comprising:

position sewing data generation processing of creating position sewing data for forming stitches indicating an arrangement, on the sewing object, of the applique piece corresponding to the cutting region cut out from the workpiece in accordance with the processing data; and position sewing processing of driving the sewing portion in accordance with the position sewing data to form, on the sewing object, the stitches indicating the arrangement of the applique piece.

14. The embroidery sewing machine according to claim 11, wherein the computer-readable instructions further instruct the processor to perform processes comprising:

fixing sewing data generation processing of creating fixing sewing data for sewing the applique piece corresponding to the cutting region cut out from the workpiece in accordance with the processing data, onto the sewing object; and fixing sewing processing of driving the sewing portion in accordance with the fixing sewing data to sewing the applique piece onto the sewing object.

15. A non-transitory computer-readable storage medium storing computer-readable instructions that are executed by a processor of a processing data generation device, the computer-readable instructions performing processes comprising:

pattern identification processing of identifying a target pattern;

notification processing of notifying options of a region specification command to select a cutting region, the options including:

a first command in which a first region is the cutting region, a second command in which a second region is the cutting region, the second region being surrounded by an outer contour, the outer contour being a contour, of the target pattern, separated from the first region, and the second region including the first region, and a third command in which a third region is the cutting region, the third region being obtained by excluding the first region from the second region;

region specification command acquisition processing of acquiring, via an input portion, the region specification command selected from among the options; and processing data generation processing of creating processing data for cutting out, from a workpiece to be cut, the cutting region specified by the region specification command, as an applique piece.

* * * * *